US005316508A

United States Patent [19]

Landucci

[11] Patent Number: 5,316,508

[45] Date of Patent: May 31, 1994

[54] WATER BICYCLE

[76] Inventor: Angelo Landucci, 16350, chemin St-Roch, Tracy, Quebec, Canada J3P 5N3

[21] Appl. No.: 4,239

[22] Filed: Jan. 14, 1993

[51] Int. Cl.[5] ..... B60F 3/00

[52] U.S. Cl. ..... 440/030; 440/031; 440/021; 114/144 R

[58] Field of Search ..... 114/61, 144 R, 270, 114/343, 362; 440/21, 26–30; 280/261

[56] References Cited

U.S. PATENT DOCUMENTS

| | | | |
|---|---|---|---|
| 540,680 | 6/1895 | Moulton | 440/30 |
| 1,761,883 | 6/1930 | Froedtert | 440/30 |
| 3,158,129 | 11/1964 | Mauer | 114/270 |
| 3,352,276 | 11/1967 | Zimmerman | 115/26 |
| 3,948,206 | 4/1976 | Tyler | 114/270 |
| 4,170,188 | 10/1979 | Jamison, Jr. | 440/30 |
| 4,474,502 | 10/1984 | Daoud | 440/29 |
| 4,511,338 | 4/1985 | Fanelli | 440/26 |
| 4,559,892 | 12/1985 | Cascallana | 440/30 |
| 4,789,365 | 12/1988 | Jones | 440/21 |
| 5,088,944 | 2/1992 | Kats | 440/26 |
| 5,127,855 | 7/1992 | Heywood | 440/14 |

FOREIGN PATENT DOCUMENTS 2583016 12/1986 Canada .

*Primary Examiner*—David M. Mitchell
*Assistant Examiner*—Stephen P. Avila
*Attorney, Agent, or Firm*—Michael D. Bednarek

[57] ABSTRACT

A human-propelled water bicycle suitable for training or recreative purposes. The water bicycle has two steerable front pontoons and two rear pontoons fixed to a main frame substantially similar to a convention bicycle frame. Handlebars are provided to turn the steerable front pontoons and therefore allowing the water bicycle to be steered. The water bicycle has a pedal mechanism and a bicycle-type transmission powering a propeller located at the rear of the water bicycle.

9 Claims, 3 Drawing Sheets

WATER BICYCLE

FIELD OF THE INVENTION

The present invention relates to a human-propelled water bicycle suitable for training or recreative purposes.

DESCRIPTION OF PRIOR ART

There are many water bicycles known in the prior art. Some have two pontoons, as in U.S. Pat. Nos. 4,789,365 and 5,088,944. Others, like in U.S. Pat. Nos. 4,474,502 and 4,511,338, are using a sail board as the main float. Finally, another example of a water bicycle can be found in French laid-open patent application no. 2,583,016.

In almost all prior art devices, rudders are used to steer the bicycle. Others, like in U.S. Pat. No. 4,511,338, select the propulsion means of the left or of the right side to steer the bicycle.

SUMMARY OF THE INVENTION

The object of the present invention is to provide a very efficient water bicycle design that allows a good maneuverability and a good stability.

More particularly, the object of the present invention is to provide a water bicycle comprising:

- a main frame;
- at least one steerable front pontoon operatively secured to the main frame, preferably two steerable front pontoons that are so connected as to remain substantially parallel to each other;
- means to steer the front pontoon;
- two rear pontoons substantially parallel to each other and rigidly secured to the main frame;
- a pedal mechanism located on the main frame;
- water propulsion means, preferably a propeller, for propelling the bicycle in water;
- transmission means connecting the pedal mechanism to the water propulsion means. Preferably, the water propulsion means are a propeller.

According to a preferred embodiment, there are provided a front suspension located between the front pontoons and the main frame.

The presence of the suspension allows to absorb the waves and to help keeping the direction even in the presence of sea waves or waves generated by a yacht.

Preferably, the transmission means may comprise a multiple speed transmission which may further comprise a derailleur. The derailleur allows the ease of the starts and to obtain higher rotation speed of the propeller.

According to another preferred embodiment, when the water propulsion means are a propeller, there is further provided means to lift up or to lower the propeller whenever desired. Such means may be a hand-jack connected between the main frame and a shaft driving the propeller. It allows the bicycle to go into shallow water and to approach or depart from the shore.

According to a still preferred embodiment, there is provided releasably securing means between the front suspension and the main frame and between the rear pontoons and the main frame.

The use of four pontoons with the two front ones steerable allows the bicycle to have more stability since their length can be greater than the length of the pontoons used in the prior art. This is due to the fact that a marine bicycle cannot be efficiently steered by a rudder if the length of the pontoons is too important.

A non restrictive description of a preferred embodiment will now be given with reference to the appended drawings.

IDENTIFICATION OF THE COMPONENTS

Figure 1:
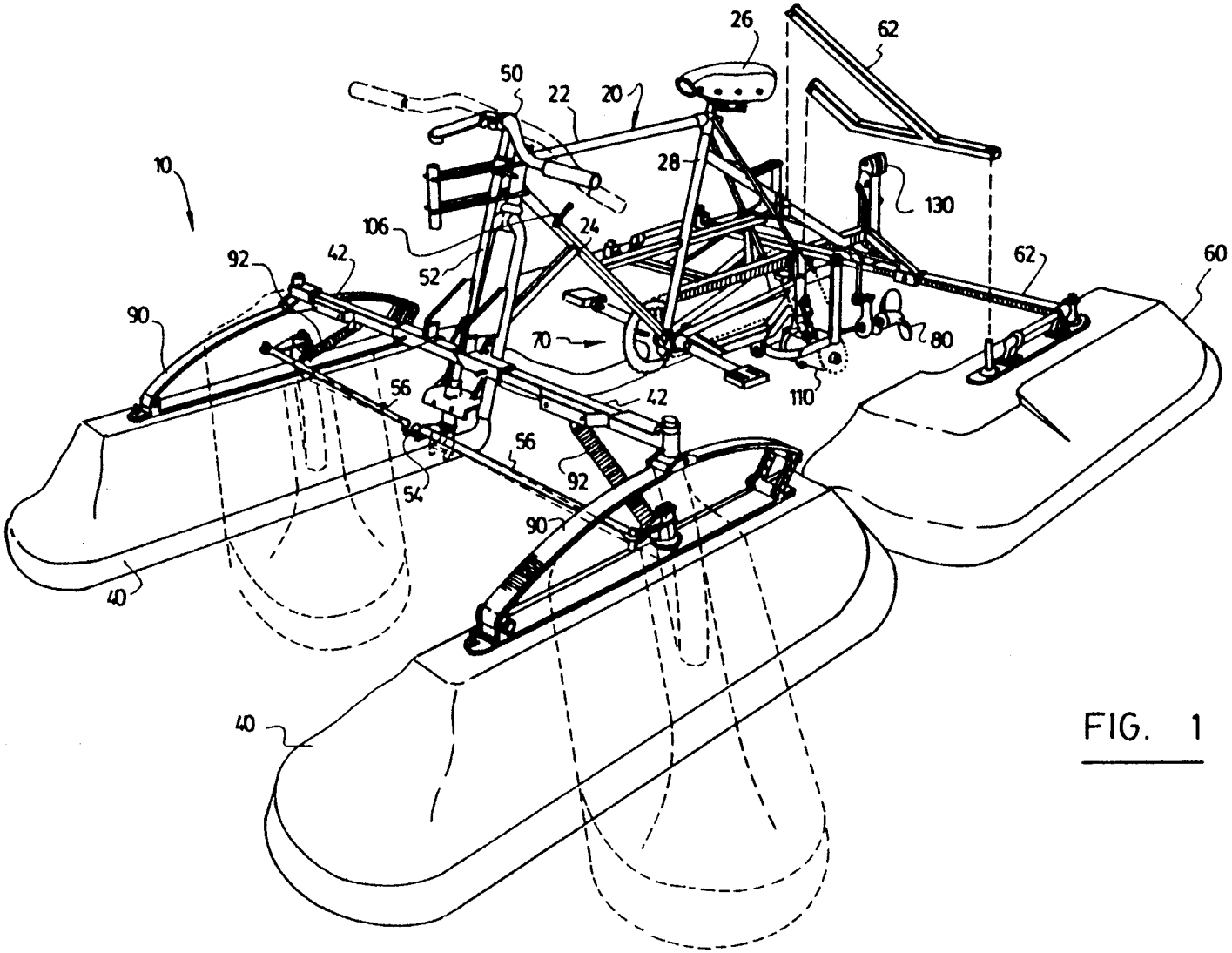
FIG. 1 is a perspective view of the water bicycle according to the invention.
Figure 2:
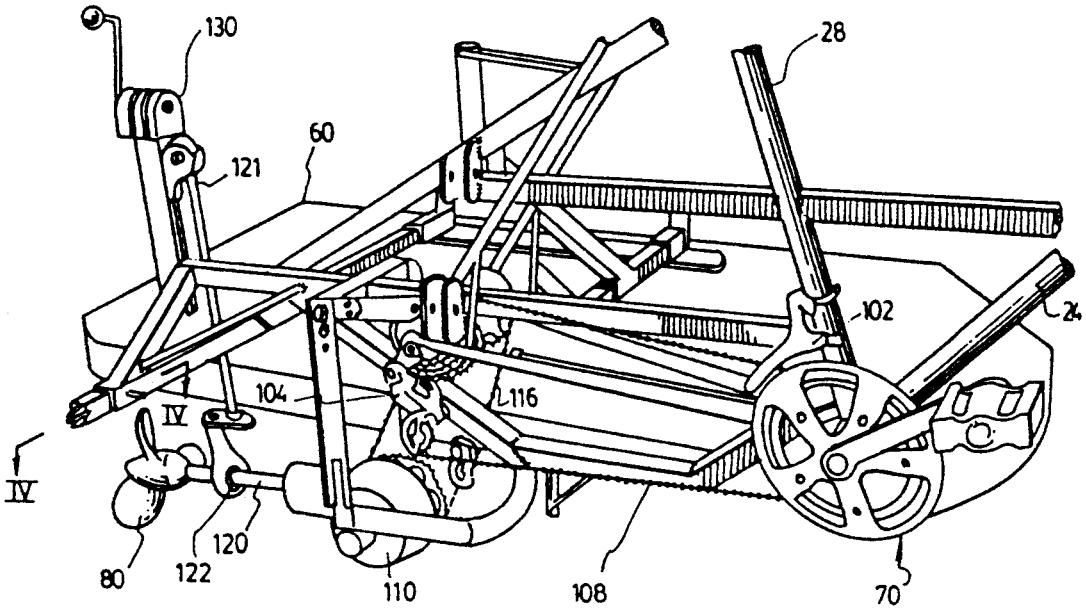
FIG. 2 is a perspective view showing the rear portion of the water bicycle.
Figure 3:
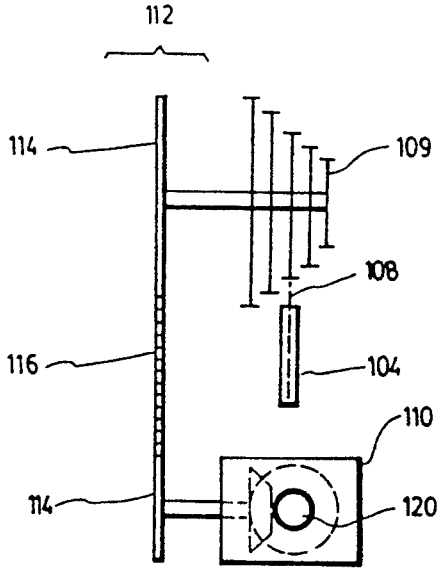
FIG. 3 is a rear elevational view of a portion of connecting means used to connect parts of the water bicycle together.

The water bicycle, according to the invention and with reference to the accompanying drawings, has the following reference numerals:

10: water bicycle
20: main frame
22: crossbar
24: down tube
26: saddle
28: seat tube
40: front pontoons
42: front side members
50: handlebars
52: vertical tube
54: plate
56: left and right side bars
60: rear pontoons
62: rear side members
70: pedal mechanism
80: propeller
90: leaf springs
92: helicoidal springs
102: front derailleur
104: rear derailleur
106: shifters
108: drive chain
109: rear set of sprockets
110: gear box
112: lateral transmission
114: sprockets
116: drive chain
120: output shaft
121: rod
122: bearing
130: hand-jack
140: securing means
142: female part
144: male part
146: cutter pin
148: small chain

DESCRIPTION OF A PREFERRED EMBODIMENT

The water bicycle 10 according to the invention as shown in FIG. 1 comprises a main frame 20 which may be, as illustrated, substantially similar to a conventional bicycle frame. This main frame 20 may comprise a crossbar 22, a down tube 24, a saddle 26 and a seat tube 28.

The main frame 10 is supported on water by two front pontoons 40 and two rear pontoons 60. The pontoons 40 and 60 are advantageously made of a buoyant material, such as polystyrene, or has advantageously a buoyant construction. The front pontoons 40 are operatively and releasably secured to the main frame 20 by means of front side members 42. The rear pontoons 60 are substantially parallel to each other and releasably secured to the main frame 20 by means of rear side members 62.

The two front pontoons 40 are operatively secured to the main frame in a way that they are steerable in the horizontal plane. By changing the angular position of the front pontoons 40, the water bicycle can be steered left and right as a set of wheels would do on the ground. Of course, the front pontoons 40 are so connected as to remain substantially parallel to each other.

The front pontoons 40 are steered by suitable means such as handlebars 50 located at the front of the main frame 20. The handlebars 50 are fixed to a substantially vertical tube 52 at the end of which is located a plate 54 operating left and right side bars 56.

A front suspension, located between the front pontoons 40 and the main frame 20, may be provided to improve stability and wave movement absorbtion. The front suspension may comprise leaf springs 90 operatively attached to the pontoons 40 and to the main frame 20, and helicoidal springs 92 connected to an adjacent front side member 42 and front pontoon 40.

Since the water bicycle 10 is human-powered, there is provided a pedal mechanism 70 located on the main frame 20 at the junction of the down tube 24 and the seat tube 28. The pedal mechanism 70 is similar to the pedal mechanisms found on conventional bicycles.

The pedal mechanism 70 is connected to water propulsion means, preferably the propeller 80, by transmission means comprising a multiple speed transmission similar to the drive chain transmission found on the convention bicycles. This multiple speed transmission comprises a front derailleur 102 and a rear derailleur 104 operated by shifters 106 for shifting the drive chain 108 from one of the sprockets of the rear set of sprockets 109 to another (FIG. 1). The output of the rear derailleur 104 then goes to a gear box 110 by means of a lateral transmission 112 comprising two sprockets 114 and a drive chain 116. The gear box 110 allows a 90° rotation of the movement in order to power an output shaft 120 at the end of which is fixed the propeller 80.

Since the propeller 80 may touch the bottom of the lake or river when the water bicycle is in shallow waters, such as when approaching or departing from the shore, there may be provided means to lift up the propeller 80 whenever desired. Such means may be a hand-jack 130 operating a rod 121 connected between the main frame 20 and the shaft 120 driving the propeller. The connection on the shaft 120 is made by means of a bearing 122 combined with a ball joint. This connection also allows the shaft 120 to be supported.

In order to be able to collapse the water bicycle 10, there is provided, as aforesaid, releasably securing means 140 between the front suspension 90 and the main frame 20 and between the rear pontoons 60 and the main frame 20. This allows to detach the pontoons 40 and 60 from the main frame 20. More releasable connections may also be provided.

Figure 4:
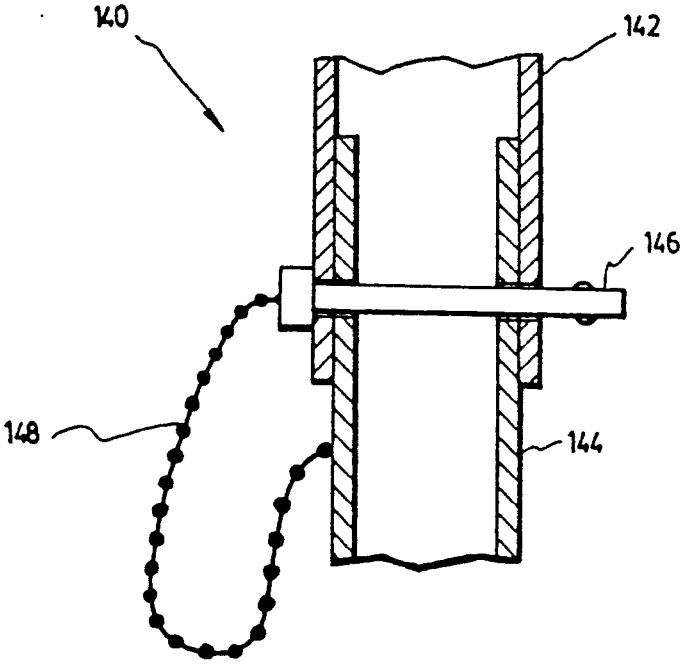
FIG. 4 is a cross-sectional view taken along line IV—IV in FIG. 2.

As shown in FIG. 4, the securing means 140 comprise a female part 142 in which a male part 144 is snugly fitted therein. Both parts 142 and 144 are locked together by means of a cotter pin 146 attached by a small chain 148 to one of the parts 142 and 144.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

I claim:

1. A water bicycle comprising:

a main frame;

a pair of steerable front pontoons operatively secured to said main frame and so connected as to remain substantially parallel to each other;

means for steering said front pontoons;

a front suspension located between said front pontoons and said main frame for improving stability and absorbing wave, movement said front suspension comprising a laterally extending frame member and a generally longitudinally extending leaf spring mounted between each front pontoon and respective lateral end of said laterally extending frame member, said laterally extending frame member comprising a pair of releasably secured side members, one of the side members extending from each side of the main frame whereby each of said front pontoons along with a respective side member and leaf spring can be removed as a unit from said main frame;

two rear pontoons substantially parallel to each other and rigidly secured to said main frame;

a pedal mechanism located on said main frame;

water propulsion means for propelling said bicycle in water; and transmission means for mechanically connecting said pedal mechanism to said water propulsion means.

2. A water bicycle according to claim 1, wherein said transmission means comprise a multiple speed transmission.

3. A water bicycle according to claim 2, wherein said multiple speed transmission comprises a derailleur.

4. A water bicycle according to claim 1, wherein said water propulsion means are a propeller.

5. A water bicycle according to claim 4, further comprising means to selectively lift up or lower said propeller whenever desired.

6. A water bicycle according to claim 5, wherein said means to lift up said propeller are a hand-jack connected between said main frame and a shaft driving said propeller.

7. A water bicycle according to claim 1, further comprising releasably securing means between said front suspension and said main frame and between said rear pontoons and said main frame.

8. A water bicycle according to claim 1, wherein said leaf springs are each pivotably mounted to a lateral end of a respective one of said side members for pivotal movement about a generally vertical axis for steering said front pontoons.

9. A water bicycle according to claim 8, wherein said front suspension further comprises first and second helicoidal springs each connected between a respective one of said side members and a respective one of said steerable front pontoons to provide added stability.

* * * * *